United States Patent [19]

Blanchard

[11] 4,382,796

[45] May 10, 1983

[54] TRANSOM MOUNTED MARINE PROPULSION DEVICE WITH VERTICAL CRANKSHAFT AND TILTABLE LOWER UNIT AND RUDDER

[75] Inventor: Clarence E. Blanchard, Kenosha, Wis.

[73] Assignee: Outboard Marine Corporation, Waukegan, Ill.

[21] Appl. No.: 247,792

[22] Filed: Mar. 26, 1981

Related U.S. Application Data

[63] Continuation-in-part of Ser. No. 188,323, Sep. 18, 1980, Pat. No. 4,371,348.

[51] Int. Cl.[3] ..... B63H 21/26

[52] U.S. Cl. ..... 440/51; 440/58; 440/75

[58] Field of Search ..... 440/49, 50, 51, 52–65, 440/75

[56] References Cited

U.S. PATENT DOCUMENTS

| | | | |
|---|---|---|---|
| 3,083,678 | 4/1963 | Leipert | 440/75 |
| 3,358,668 | 12/1967 | Post et al. | 440/77 |
| 3,492,966 | 2/1970 | Kiekhaefer | 440/75 |
| 4,037,558 | 7/1977 | Nossiter | 440/75 |

FOREIGN PATENT DOCUMENTS

| | | | |
|---|---|---|---|
| 924582 | 4/1973 | Canada | 440/51 |

*Primary Examiner*—Trygve M. Blix
*Assistant Examiner*—Jesus D. Sotelo
*Attorney, Agent, or Firm*—Michael, Best & Friedrich

[57] ABSTRACT

Disclosed herein is a marine propulsion device comprising a power head including an internal combustion engine having a vertical crankshaft with a lower end having fixed thereon a bevel gear, a lower unit including a rotatably mounted propeller shaft carrying thereon a propeller, a horizontal cross shaft journaled in the lower unit and in the power head for pivotally connecting the lower unit to the power head for vertical tilting movement about a horizontal tilt axis, a transfer gear fixed to the cross shaft and in mesh with the bevel gear, a drive shaft extending in the lower unit and drivingly connected to the propeller shaft and to the cross shaft, a reversing transmission operably connected between the cross shaft and the drive shaft, a rudder pivotally mounted on the lower unit aft of the propeller, and mechanism on the lower unit for pivoting the rudder.

18 Claims, 2 Drawing Figures

TRANSOM MOUNTED MARINE PROPULSION DEVICE WITH VERTICAL CRANKSHAFT AND TILTABLE LOWER UNIT AND RUDDER

RELATED APPLICATIONS

This application is a continuation-in-part of my earlier application, Ser. No. 188,323, filed Sept. 18, 1980 now U.S. Pat. No. 4,371,348 and entitled: MOUNTING FOR MARINE PROPULSION DEVICE LOCATED AFT OF BOAT TRANSOM, and incorporated herein by reference.

Reference is hereby made to my co-pending application entitled "TRANSOM MOUNTED MARINE PROPULSION DEVICE WITH LATERAL CRANKSHAFT AND POWER SHAFT", Ser. No. 247,995, filed Mar. 26, 1981 and to my co-pending application entitled "TRANSOM MOUNTED MARINE PROPULSION DEVICE WITH FORE AND AFT CRANKSHAFT AND POWER SHAFT", Ser. No. 247,915, filed Mar. 26, 1981.

BACKGROUND OF THE INVENTION

The invention relates generally to marine propulsion devices and more particularly to marine propulsion devices including lower units which are swingable between a lowered running position and a raised position wherein the lower unit neither engages the boat transom nor passes forwardly over the top of the boat transom when in the fully raised position.

Attention is directed to the following U.S. patents:

| | | |
|---|---|---|
| J. F. Fisher | 772,794 | December 8, 1903 |
| Johnson | 1,824,213 | September 22, 1931 |
| Williams | 2,091,247 | August 24, 1937 |
| Soldner | 2,386,362 | October 9, 1945 |
| Shively | 2,691,954 | October 19, 1954 |
| Patty, Jr. | 2,936,730 | May 17, 1960 |
| Leipert | 2,946,306 | July 26, 1960 |
| Leipert | 2,957,441 | October 25, 1960 |
| Johnson | 2,999,476 | September 12, 1961 |
| E. Leipert | 3,083,678 | December 30, 1959 |
| P. M. Hamlyn et al | 3,051,119 | December 18, 1961 |
| C. H. Harrison | 3,070,060 | December 25, 1962 |
| Cameron | 3,128,742 | April 14, 1964 |
| Langley | 3,589,204 | June 29, 1971 |
| Nossiter | 3,826,219 | July 30, 1974 |
| Kroll | 3,977,356 | August 31, 1976 |
| Shimanckas | 3,847,108 | November 12, 1974 |

Attention is also directed to the U.S. Kasmerick application, Ser. No. 034,191, filed Apr. 27, 1979 and entitled: STERN DRIVE GEAR BOX AND CLUTCHING ARRANGEMENT.

SUMMARY OF THE INVENTION

The invention provides a marine propulsion device comprising a power head including an internal combustion engine having a vertical crankshaft with a lower end having fixed thereon a bevel gear, a lower unit including a rotatably mounted propeller shaft carrying thereon a propeller, a horizontal cross shaft journaled in the lower unit and in the power head for pivotally connecting the lower unit to the power head for lower unit vertical tilting movement about a horizontal tilt axis, a transfer gear fixed to the cross shaft and in mesh with the bevel gear, and a drive shaft extending in the lower unit and drivingly connected to the propeller shaft and to the cross shaft.

In one embodiment in accordance with the invention the marine propulsion device also includes a reversing transmission operably connected between the cross shaft and the drive shaft.

In one embodiment in accordance with the invention the marine propulsion device also includes a rudder pivotally mounted on the lower unit aft of the propeller, and means on the lower unit for pivoting the rudder.

In one embodiment in accordance with the invention the power head includes an outer housing enclosing the engine and including front, side, rear, and top walls, an access opening in the top and rear walls, and an access cover removably connected to the top and rear walls for closing the access opening.

In one embodiment in accordance with the invention, the lower unit includes an upper housing section wherein the cross shaft is journaled, a lower housing section wherein the propeller shaft is journaled, and an intermediate housing section located between and joining the upper and lower housing sections and through which the drive shaft passes.

In one embodiment in accordance with the invention, the means for pivoting the rudder comprises a trunion fixed to the rudder and located in the intermediate housing section, a lower steering shaft located in the intermediate housing section and operably connected to the trunion to effect pivotal movement of the rudder in response to rotation of the lower steering shaft, a rotatable upper steering shaft, means on the power head rotatably mounting the upper steering shaft about a stationary axis, a universal coupling spanning the horizontal axis and connecting the upper steering shaft to the lower steering shaft for rotating the lower steering shaft in response to rotation of the upper steering shaft, and means for rotating the upper steering shaft.

In one embodiment in accordance with the invention, the marine propulsion device further includes means including vibration isolating means connected to the power head and adapted for connecting the power head stationarily to the rear of a boat transom.

Other features and advantages of the embodiments of the invention will become known by reference to the following general description, claims and appended drawings.

IN THE DRAWINGS

Figure 2:
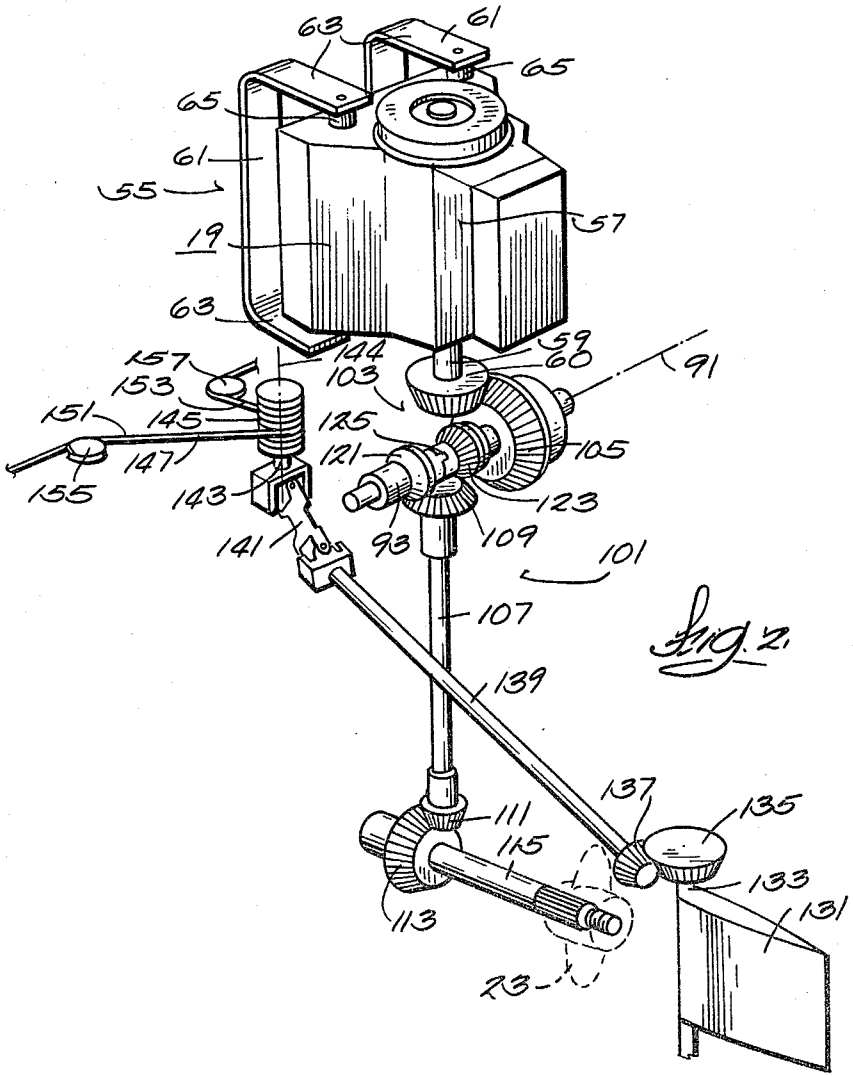
FIG. 2 is a schematic view of various of the components included in a marine propulsion device forming a part of the marine propulsion installation shown on FIG. 1.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 1:
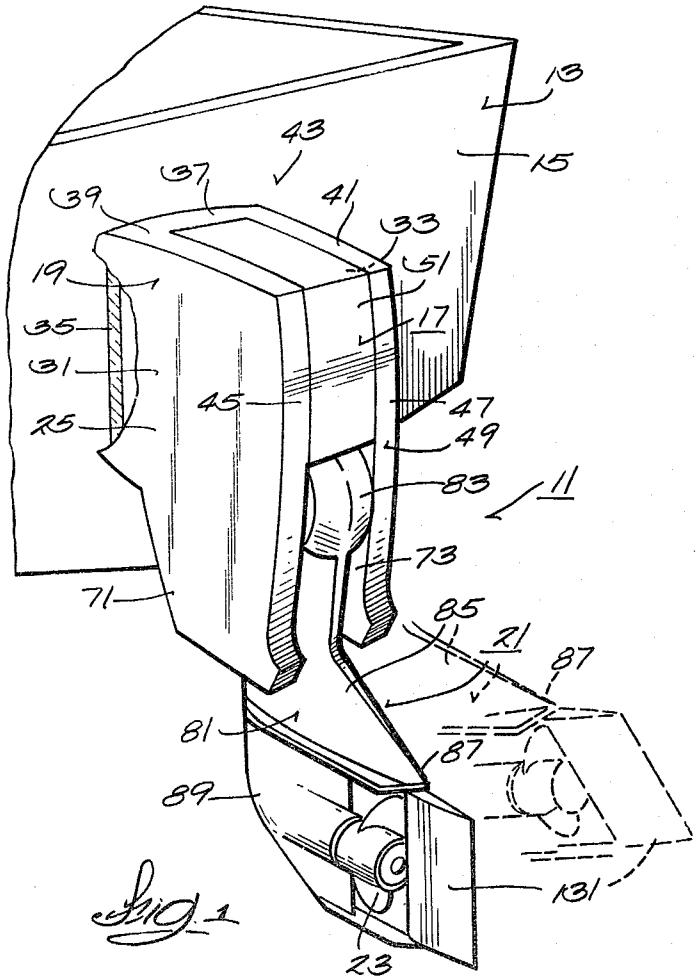
FIG. 1 is a partially broken away perspective view of a marine propulsion installation incorporating various of the features of the invention.

Shown in FIG. 1 is a marine propulsion installation 11 including a boat hull 13 having a transom 15. Mounted at the rear of the transom 15 is a marine propulsion device 17 including a stationary power head 19 and a vertically tiltable lower unit 21 including a rotatably mounted propeller 23.

The power head 19 includes a housing or frame 25 which is adapted to be stationarily mounted to the rear of the transom 15. While other arrangements can be employed, in the illustrated construction, the housing 25 comprises a U-shaped structure having laterally spaced sidewalls 31 and 33 and a transverse front wall 35 adapted to engage the rear of the transom 15. The front wall 35 includes, at the top thereof, a rearwardly extending flange portion 37 and the sidewalls 31 and 33 include, the top thereof, respective horizontal flange portions 39 and 41 which are laterally spaced from each other and which, together with the flange portion 37, form a partial top wall 43. In addition, the sidewalls 31 and 33 include, along the rear margins thereof, vertical flanges 45 and 47 which are laterally spaced from each other and which form a partial rear wall 49. A removable access panel 51 is removably connected to the U-shaped structure to complete the top wall 43 and to complete the rear wall 49.

Interiorly of the front and sidewalls 35, 31 and 33, the housing 25 also includes (See FIG. 2) suitable means 55 for vibrationally isolating and supporting an internal combustion engine 57 with a vertically arranged crankshaft 59 having fixed, at the lower end thereof, a bevel gear 60. While various arrangements can be employed, in the illustrated construction, the engine isolating and supporting means 55 comprises one or more U-shaped brackets 61 (two in the disclosed construction) which are fixed to or extend from the housing front wall 35 and which include vertically spaced upper and lower arms 63 straddling the top and bottom of the engine 57. Suitably connected to the arms 63 and to the top and bottom of the engine 57 are suitable rubber mounts 65 which support the engine 57 while affording vibration isolation.

Any suitable two-stroke or four-stroke internal combustion engine 57 of either in-line or V-block construction can be employed.

The housing sidewalls 31 and 33 include (See FIG. 1) respective portions 71 and 73 which extend downwardly beyond the lower margin of the front and rear walls 35 and 49 in straddling relation to the upper part of the tiltable lower unit 21.

The lower unit 21 includes an outer housing 81 including an upper housing section 83 which constitutes an upper gear box, an intermediate housing section 85 which extends downwardly from the upper housing section 83, an anti-cavitation plate 87 at the lower end of the intermediate housing section 85, and a lower housing section 89 in the form of a gear box extending downwardly from the cavitation plate 87.

Means are provided for mounting the lower unit 21 from the power head 19 for tilting movement about a horizontal axis 91 between a lowered running position and a raised position out of the water. While various constructions can be employed, in the illustrated construction, such means comprises (See FIG. 2) a cross shaft 93 which is journaled in and extends laterally through the upper housing section 83 and which, at its outer ends, is journaled in bearings (not shown) located on the interior surface of the depending power head side wall portions 71 and 73.

The lower unit 21 also includes a drive train 101 drivingly connecting the engine 57 to the propeller 23 and including a reversing transmission 103. While other arrangements could be employed, in the illustrated construction, the drive train 101 includes a gear 105 which is fixed to the cross shaft 93 and in mesh with the crankshaft bevel gear 60 so as to cause cross shaft rotation in response to crankshaft rotation.

In addition, the drive train 101 includes a vertical drive shaft 107 which is suitably journaled in the lower unit 21, which extends perpendicularly from the cross shaft 93, which includes an upper end having fixed thereon a bevel gear 109 located in the upper housing section 83, and a lower end having fixed thereon a bevel gear 111 located in the lower housing section 89. The bevel gear 111 is in mesh with a bevel gear 113 fixed on a propeller shaft 115 which is journaled in the lower housing section 89 and fixedly carries the propeller 23.

The reversing transmission 103 connects the cross shaft 93 to the upper drive shaft bevel gear 109 and includes a pair of facing bevel gears 121 and 123 which are mounted for rotation co-axially with and relative to the cross shaft 93 and which are in mesh with the upper drive shaft bevel gear 109.

The reversing transmission 103 further includes a dog 125 which is mounted on the cross shaft 93 between the bevel gears 121 and 123 for common rotation with the cross shaft 93 and for axial movement relative to the cross shaft 93. The dog 125 and the bevel gears 121 and 123 include complementary lug means (not shown) so that axial movement of the dog 125 into a position in engagement with the bevel gear 121 effects propeller rotation in one direction, so that axial movement of the dog 125 into a position in engagement with the other bevel gear 123 effects propeller rotation in the other rotary direction, and so that axial movement of the dog 125 to a non-engaged position between the bevel gears 121 and 123 provides a neutral drive condition.

Any suitable means (not shown) can be employed to shift the dog 125 between the neutral and drive positions.

In order to provide for steering, the lower unit 21 has pivotally mounted thereon, rearwardly of the propeller 23, a rudder 131. Any suitable means can be employed to pivotally support the rudder 131 from the lower unit 21. In the disclosed construction, the rudder 131 is fixed to an upper strut or shaft 133 which enters into the intermediate housing section 85 above the cavitation plate 87 and has fixed thereon a bevel gear 135. In mesh with the bevel gear 135 is another bevel gear 137 fixed to the lower end of a steering shaft 139 which extends upwardly through the intermediate housing section 85 and which includes an upper end connected to a universal coupling 141. In turn, the coupling 141 is connected to a steering shaft or drum 143 which is mounted on the power head 19, in the area immediately forwardly of the upper housing section 83, i.e., aft of the transom 15 but forwardly of the lower unit 21, for rotation about a fixed vertical axis 144 and which has, on the outer surface thereof, a helical groove 145. Wound in the groove 145 is a steering cable 147 having oppositely extending lengths 151 and 153. One length 151 extends forwardly and around an idler pulley 155 for connection to a suitable steering wheel mechanism (not shown) and the other length 153 extends forwardly and around a second idler pulley 157 for connection to the steering wheel mechanism (not shown). Accordingly, longitudinal movement of the cable 147 in response to steering wheel actuation causes rotation of the drum 143 which, in turn, rotates the shaft 139 and causes pivotal steering movement of the rudder 131.

If desired, the universal coupling can be located axially outwardly of one end of the cross shaft 93 so as to enable upward pivoting of the lower unit 19 without disabling the steering mechanism.

Accordingly, the lower unit 21 is upwardly swingable to a fully raised position without engagement thereof with the transom 15 and/or without travel of any part of the lower unit 21 forwardly over the top of the transom 15. In addition, the rudder 131 permits steering of the boat as desired.

Various of the features of the invention are set forth in the following claims.

I claim:

1. A marine propulsion device comprising a power head including an internal combustion engine having a vertical crankshaft with a lower end having fixed thereon a bevel gear, a lower unit including a rotatably mounted propeller shaft carrying thereon a propeller, means pivotally connecting said lower unit to said power head for lower unit vertical tilting movement about a horizontal tilt axis, a horizontal cross shaft journaled coaxially with said tilt axis, a transfer gear fixed to said cross shaft and in mesh with said bevel gear, and a drive shaft extending in said lower unit and drivingly connected to said propeller shaft and to said cross shaft.

2. A marine propulsion device in accordance with claim 1 and further including a reversing transmission operably connected between said cross shaft and said drive shaft.

3. A marine propulsion device in accordance with claim 2 wherein said reversing transmission comprises a pair of spaced bevel gears mounted for rotation coaxially with and relative to said cross shaft and a clutch dog movably mounted on said cross shaft between said bevel gears for common rotation with said cross shaft and for axial movement relative to said cross shaft between a neutral position wherein said clutch dog is free of engagement with said bevel gears, a first drive position wherein said clutch dog is drivingly engaged with one of said bevel gears, and a second drive position wherein said clutch dog is drivingly engaged with the other of said bevel gears.

4. A marine propulsion device in accordance with claim 3 and further including a rudder pivotally mounted on said lower unit aft of said propeller, and means on said lower unit for pivoting said rudder.

5. A marine propulsion device in accordance with claim 4 wherein said lower unit includes an upper housing section wherein said cross shaft is journaled, a lower housing section wherein said propeller shaft is journaled, and an intermediate housing section located between and joining said upper and lower housing sections and through which said drive shaft passes.

6. A marine propulsion device comprising a power head including an internal combustion engine having a vertical crankshaft with a lower end having fixed thereon a bevel gear, a lower unit including an upper housing section, a lower housing section, and an intermediate housing section located between and joining said upper and lower housing sections, a propeller shaft rotatably mounted in said lower housing section and carrying thereon a propeller, means pivotally connected said lower unit to said power head for lower unit vertical tilting movement about a horizontal tilt axis, a horizontal cross shaft journaled in said upper housing section coaxially with said tilt axis, a transfer gear fixed to said cross shaft and in mesh with said bevel gear, a drive shaft extending through said intermediate housing section and drivingly connected to said propeller shaft and to said cross shaft, a rudder pivotally mounted on said lower unit aft of said propeller, and means on said lower unit for pivoting said rudder, said means for pivoting said rudder comprising a trunion fixed to said rudder and located in said intermediate housing section, a lower steering shaft located in said intermediate housing section and operably connected to said trunion to effect pivotal movement of said rudder in response to rotation of said lower steering shaft, a rotatable upper steering shaft, means on said power head rotatably mounting said upper steering shaft about a stationary axis, a universal coupling spanning said horizontal axis and connecting said upper steering shaft to said lower steering shaft for rotating said lower steering shaft in response to rotation of said upper steering shaft, and means for rotating said upper steering shaft.

7. A marine propulsion device comprising a power head including an internal combustion engine having a vertical crankshaft with a lower end having fixed thereon a bevel gear, said power head also including an outer housing enclosing said engine and including front, side, rear and top walls, means in said top and rear walls defining an access opening, and an access cover removably connected to said top and rear walls for closing said access opening, said device also including a lower unit including a rotatably mounted propeller shaft carrying thereon a propeller, means pivotally connecting said lower unit to said power head for lower unit vertical tilting movement about a horizontal tilt axis, a horizontal cross shaft journaled coaxially with said tilt axis, a transfer gear fixed to said cross shaft and in mesh with said bevel gear, and a drive shaft extending in said lower unit and drivingly connected to said propeller shaft and to said cross shaft.

8. A marine propulsion device comprising a power head including an internal combustion engine having a vertical crankshaft with a lower end having fixed thereon a bevel gear, a lower unit including a rotatably mounted propeller shaft carrying thereon a propeller, means pivotally connecting said lower unit to said power head for lower unit vertical tilting movement about a horizontal tilt axis, a horizontal cross shaft journaled coaxially with said tilt axis, a transfer gear fixed to said cross shaft and in mesh with said bevel gear, a drive shaft extending in said lower unit and drivingly connected to said propeller shaft and to said cross shaft, and means including vibration isolating means connected to said power head and adapted for connecting said power head stationarily to the rear of a boat transom.

9. A marine propulsion device comprising a power head including an internal combustion engine, and a lower unit including a hollow interior and a rotatably mounted propeller shaft driven by said engine and carrying thereon a propeller, a horizontal cross shaft journaled in said lower unit and in said power head for pivotally connecting said lower unit to said power head for vertical tilting movement about a horizontal tilt axis, a rudder pivotally mounted on said lower unit aft of said propeller, a trunion fixed to said rudder and located in said lower unit hollow interior, a lower steering shaft located in said lower unit hollow interior and operably connected to said trunion to effect pivotal movement of said rudder in response to rotation of said lower steering shaft, a rotatable upper steering shaft, means on said power head rotatably mounting said upper steering shaft about a stationary axis, a universal coupling spanning said horizontal axis and connecting said upper steering shaft to said lower steering shaft for rotating said lower steering shaft in response to rotation of said upper steering shaft, and means for rotating said upper steering shaft.

10. A marine propulsion device comprising a power head including an internal combustion engine having a vertical crankshaft with a lower end having fixed thereon a bevel gear, and means including vibration isolation means for mounting said power head to the rear of a boat transom, a lower unit including an upper housing section, a lower housing section, and an intermediate housing section joining said upper and lower housing sections, a propeller shaft rotatably mounted in said lower housing section and carrying thereon a propeller, a horizontal cross shaft journaled in said upper housing section and in said power head for pivotally connecting said lower unit to said power head for vertical tilting movement about a horizontal tilt axis, a transfer gear fixed to said cross shaft and in mesh with said bevel gear, a drive shaft extending in said lower unit and including a lower end located in said lower housing section and drivingly connected to said propeller shaft and an upper end located in said upper housing section and having fixed thereon a second bevel gear, a pair of spaced third and fourth bevel gears in mesh with said second bevel gear and mounted for rotation coaxially with and relative to said cross shaft, a clutch dog movably mounted on said cross shaft between said third and fourth bevel gears for common rotation with said cross shaft and for axial movement relative to said cross shaft between a neutral position wherein said clutch dog is free of engagement with said third and fourth bevel gears, a first drive position wherein said clutch dog is drivingly engaged with said third bevel gear, and a second drive position wherein said dog is drivingly engaged with the said fourth bevel gear, a rudder pivotally mounted on said lower unit aft of said propeller, a trunion fixed to said rudder and located in said intermediate housing section, a lower steering shaft located in said intermediate housing section and operably connected to said trunion to effect pivotal movement of said rudder in response to rotation of said lower steering shaft, a rotatable upper steering shaft, means on said power head rotatably mounted said upper steering shaft about a stationary axis, a universal coupling spanning said horizontal axis and connecting said upper steering shaft to said lower steering shaft for rotating said lower steering shaft in response to rotation of said upper steering shaft, and means for rotating said upper steering shaft.

11. A marine propulsion device in accordance with claim 10 wherein said power head includes an outer housing enclosing said engine and including front, side, rear, and top walls, means in said top and rear walls defining an access opening, and an access cover removably connected to said top and rear walls for closing said access opening.

12. A marine installation comprising a boat having a transom and a marine propulsion device including a power head fixed to said boat transom and comprising an internal combustion engine having a vertical crankshaft with a lower end having fixed thereon a bevel gear, a lower unit including a rotatably mounted propeller shaft carrying thereon a propeller, means for pivotally connecting said lower unit to said power head for lower unit vertical tilting movement about a horizontal tilt axis, a horizontal cross shaft journaled coaxially with said tilt axis, a transfer gear fixed to said cross shaft and in mesh with said bevel gear, a drive shaft extending in said lower unit and including a lower end drivingly connected to said propeller shaft and an upper end, a reversing transmission operably connected between said cross shaft and said upper end of said drive shaft, a rudder pivotally mounted on said lower unit aft of said propeller, and means on said lower unit for pivoting said rudder.

13. A marine propulsion device comprising a power head including an internal combustion engine having a vertical crankshaft with a lower end having fixed thereon a bevel gear, a lower unit including a rotatably mounted propeller shaft carrying thereon a propeller, means pivotally connecting said lower unit to said power head for lower unit vertical tilting movement about a horizontal tilt axis, a horizontal cross shaft located below said bevel gear and coaxially with said tilt axis, a drive shaft extending in said lower unit and including, at the upper end thereof, a bevel gear and, at the lower end thereof, being drivingly connected to said propeller shaft, a transfer gear fixed to said cross shaft and drivingly connected to one of said bevel gears, and a reversing transmission drivingly connected between said cross shaft and the other of said bevel gears.

14. A marine propulsion device in accordance with claim 13 and further including a rudder pivotally mounted on said lower unit aft of said propeller, and means on said lower unit for pivoting said rudder.

15. A marine propulsion device comprising a power head including an internal combustion engine having a vertical crankshaft with a lower end having fixed thereon a bevel gear, means connected to said power head and adapted for stationarily locating said power head to the rear of a lower transom, a lower unit including a rotatably mounted propeller shaft carrying thereon a propeller, means pivotally connecting said lower unit to said power head for lower unit vertical tilting movement about a horizontal tilt axis, a horizontal cross shaft located below said bevel gear and coaxially with said tilt axis, a drive shaft extending in said lower unit and including, at the upper end thereof, a bevel gear and, at the lower end thereof, being drivingly connected to said propeller shaft, a transfer gear fixed to said cross shaft and drivingly connected to one of said bevel gears, and a reversing transmission drivingly connected between said cross shaft and the other of said bevel gears.

16. A marine propulsion device in accordance with claim 15 and further including a rudder pivotally mounted on said lower unit aft of said propeller, and means on said lower unit for pivoting said rudder.

17. A marine propulsion device comprising a power head including an internal combustion engine having a vertical crankshaft with a lower end having fixed thereon a bevel gear, means connected to said power head and adapted for stationarily locating said power head to the rear of a boat transom, a lower unit including a rotatably mounted propeller shaft carrying thereon a propeller, means pivotally connecting said lower unit to said power head for lower unit vertical tilting movement about a horizontal tilt axis, a horizontal cross shaft journaled coaxially with said tilt axis, a transfer gear fixed to said cross shaft and in mesh with said bevel gear, and a drive shaft extending in said lower unit and drivingly connected to said propeller shaft and to said cross shaft.

18. A marine propulsion device in accordance with claim 17 and further including a rudder pivotally mounted on said lower unit aft of said propeller, and means on said lower unit for pivoting said rudder.

* * * * *

UNITED STATES PATENT AND TRADEMARK OFFICE

CERTIFICATE OF CORRECTION

PATENT NO. : 4,382,796

DATED : May 10, 1983

INVENTOR(S) : Clarence E. Blanchard

It is certified that error appears in the above-identified patent and that said Letters Patent are hereby corrected as shown below:

Claim 15, column 8, line 32, "lower" (first occurrence) should be -- boat --.

Signed and Sealed this

*Ninth* Day of *July 1985*

[SEAL]

*Attest:*

DONALD J. QUIGG

*Attesting Officer*

*Acting Commissioner of Patents and Trademarks*